US008597236B2

(12) United States Patent
Nassiri et al.

(10) Patent No.: US 8,597,236 B2
(45) Date of Patent: Dec. 3, 2013

(54) SELF-CONTAINED MEDICATION APPARATUS

(75) Inventors: Sarah Nassiri, Gregory, MI (US); Brian Sulisz, Gregory, MI (US)

(73) Assignee: Meninas Inc., Gregory, MI (US)

( * ) Notice: Subject to any disclaimer, the term of this patent is extended or adjusted under 35 U.S.C. 154(b) by 12 days.

(21) Appl. No.: 13/068,987

(22) Filed: May 25, 2011

(65) Prior Publication Data

US 2012/0302948 A1 Nov. 29, 2012

(51) Int. Cl.

| | |
|---|---|
| ***A61J 7/00*** | (2006.01) |
| ***B65D 1/24*** | (2006.01) |
| ***B65D 77/00*** | (2006.01) |
| ***A61J 1/00*** | (2006.01) |
| ***B65D 81/32*** | (2006.01) |

(52) U.S. Cl.
USPC ..... 604/78; 220/523; 206/217; 215/204; 426/115

(58) Field of Classification Search
USPC ..... 220/520–521, 523, 212, 711–712, 716, 220/703; 206/216–217, 223; 215/6, 204, 215/258; 426/115, 120, 86; D7/396.2; D9/452; 604/78
See application file for complete search history.

(56) References Cited

U.S. PATENT DOCUMENTS

| | | | | | |
|---|---|---|---|---|---|
| 2,076,132 | A | * | 4/1937 | Le Rose | 426/115 |
| 2,766,796 | A | * | 10/1956 | Tupper | 220/521 |
| 4,393,974 | A | * | 7/1983 | Levesque | 206/37 |
| 5,168,140 | A | * | 12/1992 | Welker | 219/689 |
| 5,474,177 | A | * | 12/1995 | Abrams et al. | 206/710 |
| 6,068,865 | A | * | 5/2000 | Lee et al. | 426/43 |
| 6,102,209 | A | * | 8/2000 | D'Andrea | 206/581 |
| D458,837 | S | * | 6/2002 | Cragie | D3/203.2 |
| 6,472,007 | B2 | * | 10/2002 | Bezek et al. | 426/115 |
| 6,705,463 | B1 | * | 3/2004 | Bucholtz et al. | 206/315.9 |
| 6,761,283 | B1 | * | 7/2004 | Gilliam et al. | 220/837 |
| 7,032,507 | B2 | * | 4/2006 | Cai | 99/323 |
| D599,032 | S | * | 8/2009 | Bucholtz et al. | D24/224 |
| D599,655 | S | * | 9/2009 | Friebe et al. | D9/420 |
| D605,510 | S | * | 12/2009 | Weber | D9/449 |
| 2011/0048442 | A1 | * | 3/2011 | Pires et al. | 132/200 |
| 2011/0049154 | A1 | * | 3/2011 | Michalsky | 220/288 |
| 2011/0127269 | A1 | * | 6/2011 | Bucholtz et al. | 220/378 |
| 2011/0135377 | A1 | * | 6/2011 | Teller | 401/88 |

* cited by examiner

*Primary Examiner* — Quynh-Nhu H Vu
(74) *Attorney, Agent, or Firm* — Warn Partners, P.C.

(57) ABSTRACT

A self-contained medication apparatus which includes a first container having a first semi-spherical portion, and a second container having a second semi-spherical portion and a cylindrical portion formed with the second semi-spherical portion. At least one type of medication disposed within the first container, such as one or more pills, and a consumable liquid disposed within the second container. The first container is pivotally connected to the second container by a hinge member between an open position and a closed position. A first seal is connected to the first semi-spherical portion of the first container, and a second seal is connected to the cylindrical portion of the second container. The first seal and the second seal are removed to allow the medication to be removed from the first container and allow access to the consumable fluid such that the medication and the consumable fluid may be ingested.

16 Claims, 4 Drawing Sheets

SELF-CONTAINED MEDICATION APPARATUS

FIELD OF THE INVENTION

The present invention relates to a single-use medication apparatus which is disposable, where the apparatus has two containers, one of which contains medication, and another of which contains fluid, such as water.

BACKGROUND OF THE INVENTION

It is common for travelers to take medication on trips so the medication is available when needed. Some types of medication is prescription, other types of medication are available over the counter. Many types of over the counter drugs are sold in pill form, and as many as a few hundred pills are stored in a container, such as a bottle. However, there are times when it is inconvenient to carry an entire bottle of pills all the time, especially when only one or two pills may be needed. Furthermore, most pills are taken with water or some other type of consumable fluid, which may not be readily available when traveling. Furthermore, when traveling by airplane, there are limits to the amount of liquid which may be brought to the airport and taken on a plane. It is commonplace for only one or two doses of medication to be necessary throughout the day, therefore making it unnecessary to carry an entire bottle of pills. Additionally, if only one or two doses of medication are necessary, then it may not be cost-effective to buy an entire bottle of pills and water.

Accordingly, there exists a need for a device which is usable for carrying medication in pill form as well as a consumable fluid, provides a single-dose of the medication, and is disposable.

SUMMARY OF THE INVENTION

The present invention is directed to a self-contained medication apparatus. More specifically, the present invention is a self-contained medication apparatus which includes a first container having a first semi-spherical portion, and a second container having a second semi-spherical portion and a cylindrical portion formed with the second semi-spherical portion. At least one type of medication is disposed within the first container, such as one or more pills, and a consumable liquid is disposed within the second container.

The first container is pivotally connected to the second container by a hinge member between an open position and a closed position. The hinge member has a locking feature which is operable for locking the first container and the second container in the open position.

The present invention also includes a locking mechanism for providing a snap-fit connection between the first container and the second container when the first container and the second container are in the closed position.

A first seal is connected to the first semi-spherical portion of the first container, and a second seal is connected to the cylindrical portion of the second container. The first seal has a first tab which is pulled to remove the first seal, allowing access to the medication inside the first container. The second seal has a second tab which is pulled to remove the second seal from the second container, allowing access to the consumable fluid such that the medication and the consumable fluid may be ingested.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 7B top view of a self-contained medication apparatus in a fully open position with both seals removed, according to the present invention.

DETAILED DESCRIPTION OF THE PREFERRED EMBODIMENTS

Figure 2:
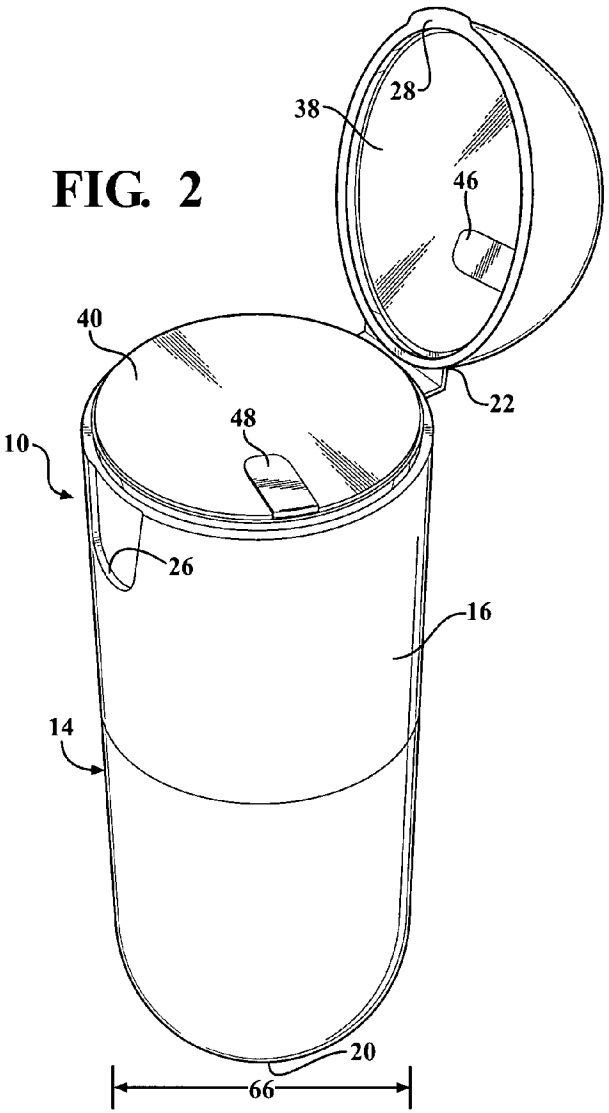
FIG. 2 is a perspective view of a self-contained medication apparatus is a partially open position, according to the present invention.

The following description of the preferred embodiment(s) is merely exemplary in nature and is in no way intended to limit the invention, its application, or uses.

An embodiment of a self-contained medication apparatus is shown in the Figures generally at 10. The apparatus 10 includes at least two containers, a first container, generally shown at 12, and a second container, generally shown at 14. The second container 14 has a substantially cylindrical portion 16. The first container 12 is made of a first semi-spherical portion 18 which is pivotally connected to the cylindrical portion 16. There is also a second semi-spherical portion 20 formed as part of the second container 14, and connected to the cylindrical portion 16.

The first container 12 is connected to the second container 14 by a hinge member 22 and a locking mechanism, shown generally at 24. The locking mechanism 24 provides a snap fit connection between the first container 12 and the second container 14 such that the first container 12 is pivotable relative to the second container 14 about the hinge member 22, and the locking mechanism 24 is operable to connect the containers 12,14 together such that the containers 12,14 do not move relative to one another.

Figure 1:
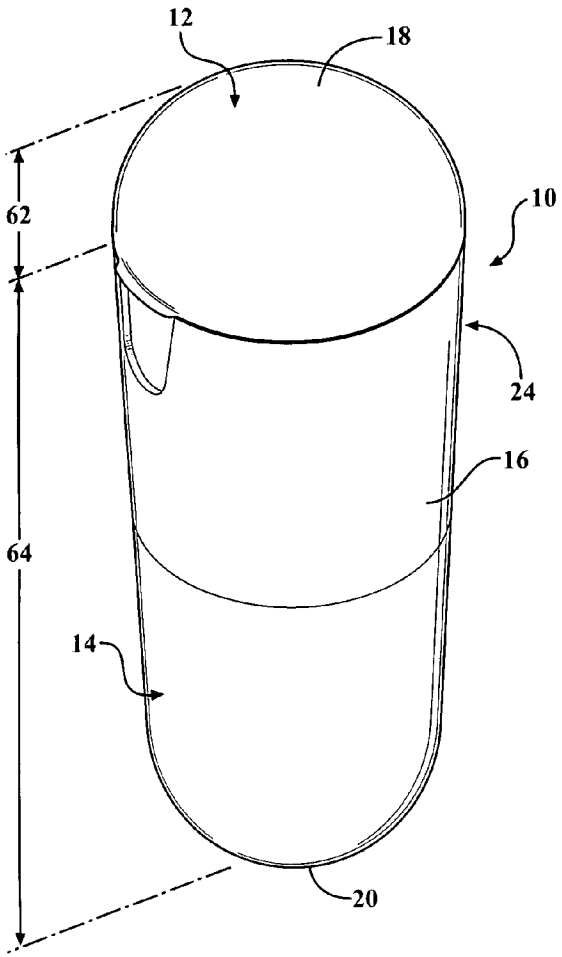
FIG. 1 is a perspective view of a self-contained medication apparatus, according to the present invention.
Figure 4:
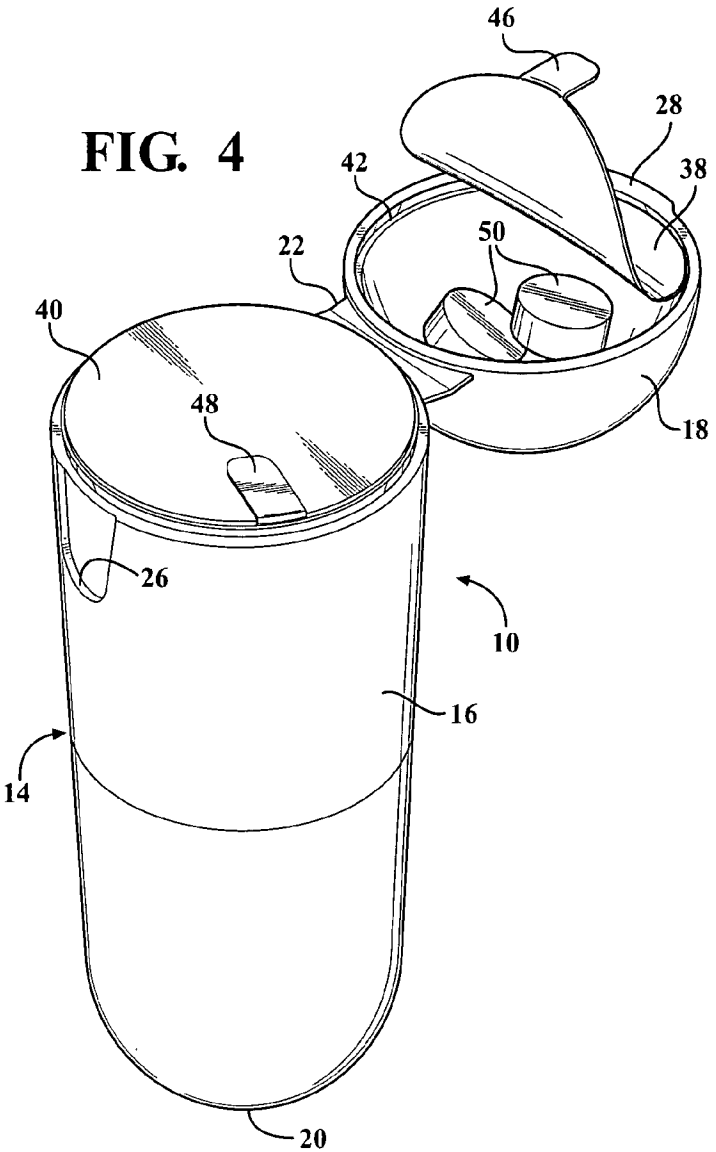
FIG. 4 is a perspective view of a self-contained medication apparatus in a fully open position, with one of the seals partially removed, according to the present invention.
Figure 3:
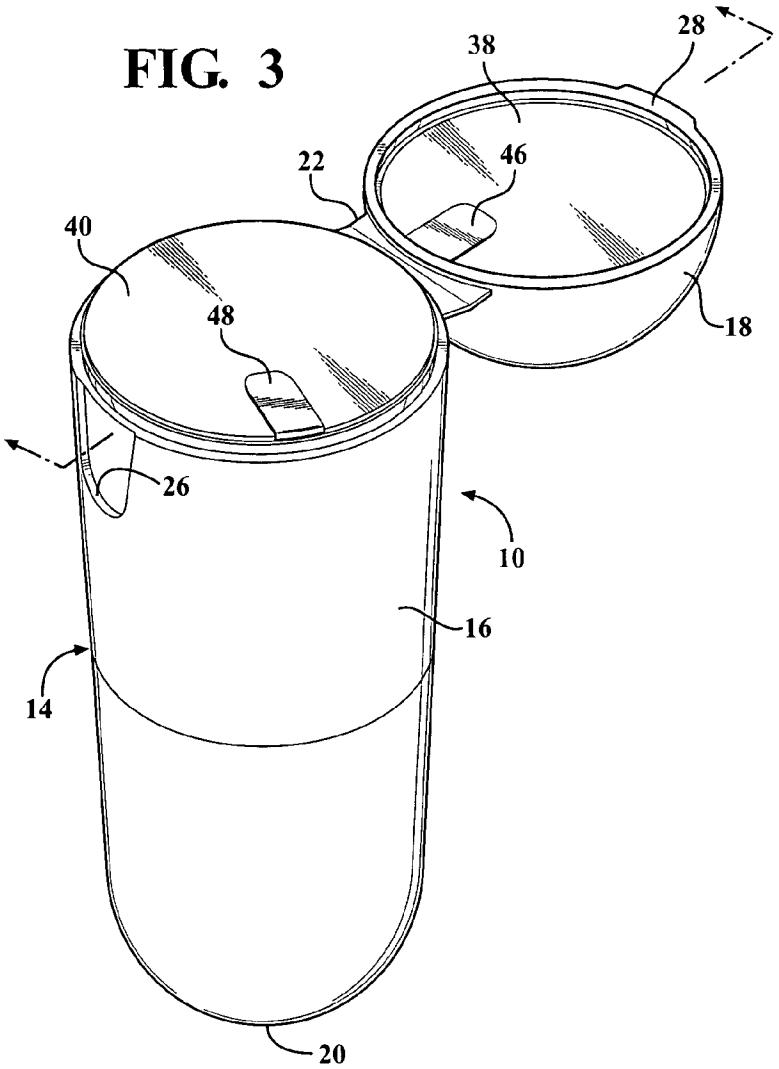
FIG. 3 is a perspective view of a self-contained medication apparatus in a fully open position, according to the present invention.
Figure 6:
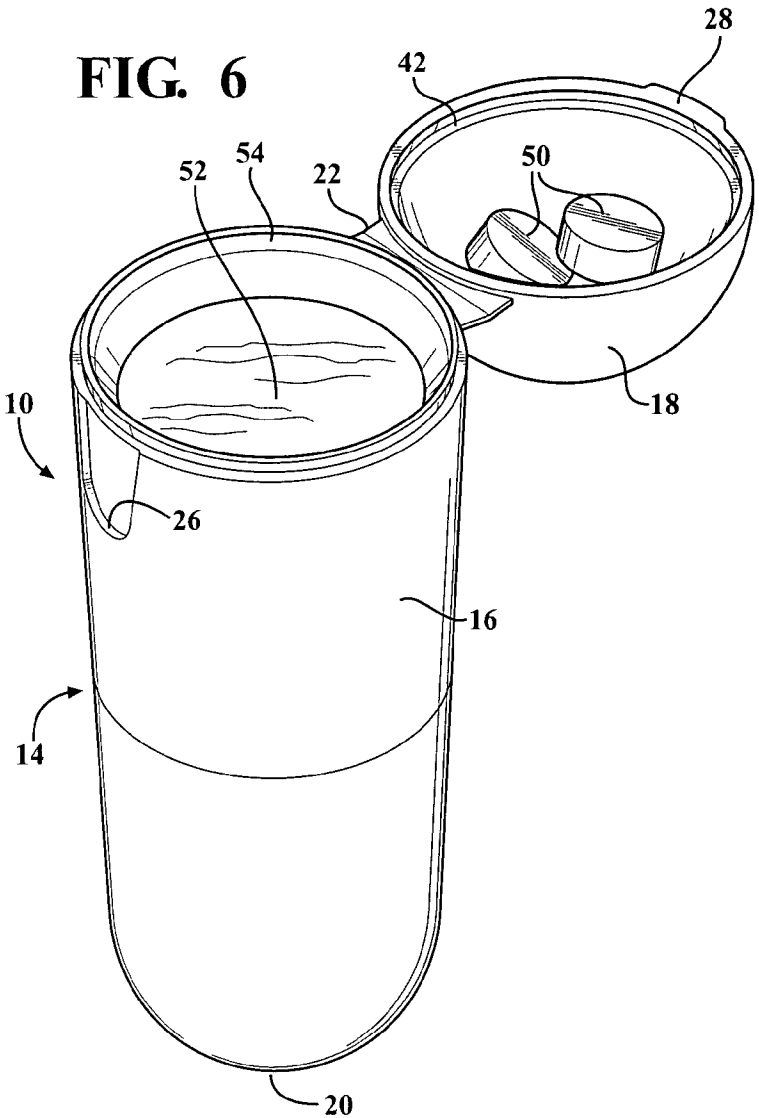
FIG. 6 is a perspective view of a self-contained medication apparatus in a fully open position with both seals removed, according to the present invention.
Figure 5:
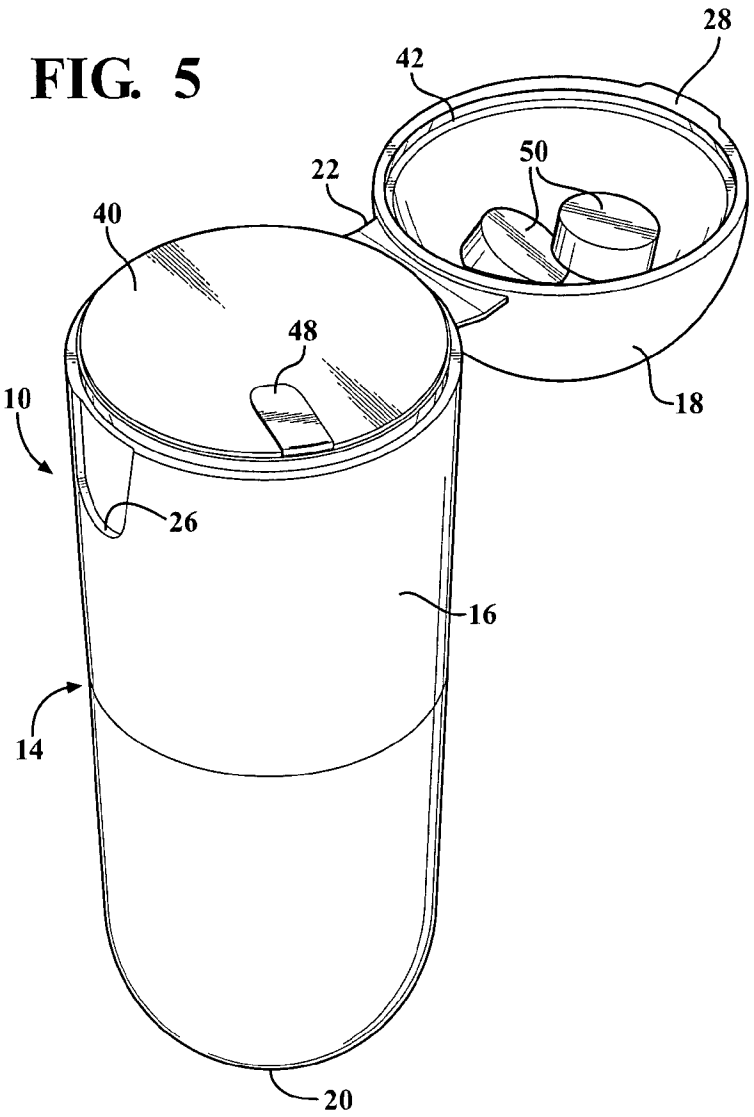
FIG. 5 is a perspective view of a self-contained medication apparatus in a fully open position, with one of the seals fully removed, according to the present invention.
Figure 7A:
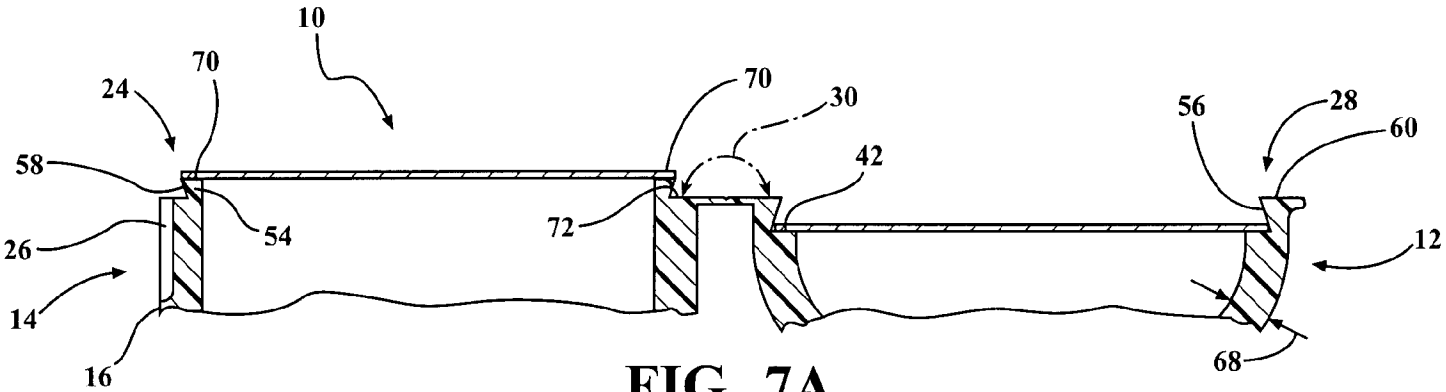
FIG. 7A is a partial sectional side view of a self-contained medication apparatus in a fully open position with both seals removed, according to the present invention.
Figure 7B:
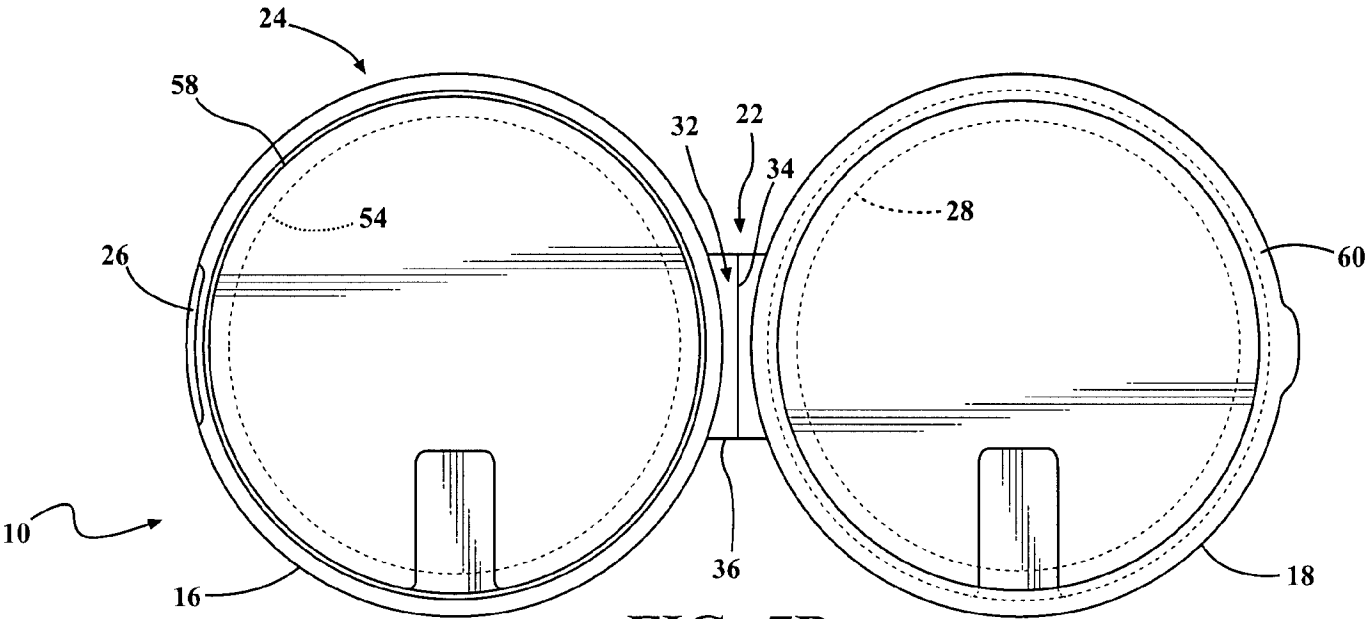

The locking mechanism 24 includes a divot 26 formed as part of the cylindrical portion 16, an overhanging lip 28 formed as part of the first semi-spherical portion 18, and an angled lip 54 formed as part of the cylindrical portion 16. When the apparatus 10 is in the closed portion, as shown in FIG. 1, the overhanging lip 28 has an angled portion which includes a contact surface 56 which contacts a corresponding contact surface 58 of the angled lip 54, forming an interference fit, and securing the apparatus 10 in the closed portion.

When in the closed position, a bottom surface 60 of the overhanging lip 28 is in contact with a ledge 72 formed as part of the cylindrical portion 16. When it is desired to change the apparatus 10 to the open position, as shown in FIGS. 3-7B, a force is applied to the bottom surface 60 of the overhanging lip 28 in the area of the divot 26 to deflect the overhanging lip 28 and the angled lip 54, allowing the contact surfaces 56,58 to rub against one another, displacing the overhanging lip 28 from the angled lip 54, and therefore allowing the first container 12 to be pivoted relative to the second container 14 about the hinge member 22. The divot 26 allows easy access to the bottom surface 60 of the overhanging lip 28.

When moved to the open position, the hinge member 22 maintains the position of the first container 12 at one-hundred-eighty degrees relative to the position of the first container 12 when in the closed position, shown by the angle 30. This is achieved by a locking feature, shown generally at 32, formed as part of the hinge member 22. The locking feature 32 is formed by the shape of the hinge member 22. There is a first deflection portion 34 and a second deflection portion 36, and when the first container 12 is pivoted relative to the second container 14 toward the open position, the deflection portions 34,36 lock the first container 12 in place, as shown in FIGS. 3-6.

Located in the first semi-spherical portion 18 is a first seal 38, and located in the cylindrical portion 16 is a second seal 40. The first seal 38 is mounted on a lip 42 formed as part of the first semi-spherical portion 18, and is connected to the lip 42 by an adhesive. The second seal 40 is mounted on part of a top surface 70 of the angled lip 54 formed as part of the cylindrical portion 16, and is also attached to the top surface 70 by an adhesive. The second seal 40 connected to the top surface 70 and the first seal 38 connected to the lip 42 do not interfere with the operation of the locking mechanism 24. While the seals 38,40 in this embodiment are made of a thin, flexible, plastic material, it is within the scope of the invention that other types of materials may be used, such as a thin foil aluminum, a clear plastic, or any other suitable material which functions to separate the first container 12 from the second container 14.

The first seal 38 also has a first tab 46, and the second seal 40 has a second tab 48. The seals 38,40 separate the internal volumes of the containers 12,14 from one another. Medication 50 is stored in the first container 12, and a consumable liquid 52, which in this embodiment is water, is stored in the second container 14.

The apparatus 10 is typically in the stowed position, and when it is desired to consume the medication 50, the user simply changes the apparatus 10 such that the first container 12 is locked in the open position. Essentially, the user applies force to the bottom surface 60 to deflect the overhanging lip 28 and the angled lip 54, and allow the first container 12 to pivot relative to the second container 14 as described above, until the first container 12 is locked in the open position. The locking feature 32 maintains the position of the first container 12 in the open position, and prevents the first container 12 from unintentionally moving back to toward the closed position. The first tab 46 is then pulled with enough force to overcome the force of the adhesive connecting the first seal 38 to the lip 42, best shown in FIG. 4, to remove the first seal 38 and allow for the medication 50 to be removed from the first container 12 and consumed. The second tab 48 is then pulled with enough force to overcome the force of the adhesive connecting the second seal 40 to the top surface 70, thereby removing the second seal 40 from the second container 14, allowing the water 52 to be consumed. The apparatus 10 of the present invention provides the advantage of not requiring a surface for supporting either of a bottle of pills or a bottle of water while the bottle of pills or bottle of water is opened, allowing for two hands to be used to operate the apparatus 10 while walking or performing some other task.

In the alternative both seals 38,40 may be removed prior to consuming the mediation 50 or water 52, and the user then may consume the medication 50 and the water 52 in the conventional manner. The apparatus 10 provides a simple, yet effective way of traveling with medication, without traveling with an entire bottle of medication, and a separate bottle of water to use when consuming the medication. Each container 12,14 is made of a disposable and recyclable material, so after consuming the medication and the water, the entire apparatus 10 may be deposited in a recycle bin. Once the seals 38,40 have been removed, the seals 38,40 may be placed back inside the apparatus 10 (which snaps shut because of the locking mechanism 24), allowing the user to carry the apparatus 10 until a recycling bin is found.

In this embodiment, the overall length of the apparatus 10 is about 3.5 inches, with the first container 12 having a length 62 of about 0.5 inches and the second container 14 having a length 64 of about 3.0 inches. The diameter 66 of the containers 12,14 is about 1.25 inches. Additionally, the wall thickness 68 of the apparatus 10 is about 0.03 inches. The apparatus 10 is small enough to only contain the maximum amount of water allowed through airport security (about 2.7 ounces, which is 0.3 ounces less than the maximum of 3.0 ounces allowed through airport security), which would allow the apparatus 10 to be taken on an airplane when traveling. However, in alternate embodiments, the apparatus 10 may be made of different sizes to contain different amounts of medication 50 and different amounts of water 52.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A self-contained medication apparatus, comprising:

a first container;

a first seal being part of said first container; a second container pivotally connected to said first container such that said first container and said second container are operable to be moved between an open position and a closed position;

a second semi-spherical portion formed as a lower part of said second container such that said self-contained medication apparatus has a rounded bottom surface;

a second seal being part of said second container, said first seal and said second seal separating said first container and said second container;

a hinge member connecting said first container and said second container such that said first container and said second container are movable between an open position and a closed position, wherein said hinge member is a locking hinge to maintain a flat open position of said hinge member and hold said first container and second container in said open position; a type of medication disposed within said first container; and a consumable liquid disposed within said second container, wherein said second container is operably sized to contain a maximum amount of consumable liquid of not more than about 2.7 ounces;

wherein said first seal is removed from said first container and said second seal is removed from said second container, allowing said medication and said consumable liquid to be consumed; wherein said self-contained medication apparatus is a single-use medication apparatus which is disposable and formed of recyclable material;

a locking mechanism provides a connection between said first container and said second container when said first container and said second container are in said closed position; said locking mechanism further comprising: an overhanging lip formed as part of said first container; an angled portion formed as part of said overhanging lip, said angled portion having a first contact surface; an angled lip formed as part of said second container, said angled lip having a second contact surface in contact with said first contact surface when said first container and said second container are in said closed position; and a bottom surface formed as part of said overhanging lip, said bottom surface operable for being selectively in contact with a ledge formed as part of said second container when said first container and said second container are in said closed position; a first deflection portion and a second deflection portion, wherein said first deflection portion and said second deflection portion lock said first container in said open position at one-hundred-eighty degrees relative to the position of said first container when in said closed position.

2. The self-contained medication apparatus of claim 1, said first container further comprising:

a first semi-spherical portion; and a lip formed as part of said first semi-spherical portion, said first seal being attached to said lip.

3. The self-contained medication apparatus of claim 2, further comprising a first tab connected to said first seal, wherein said first tab is pulled to remove said first seal from said lip, exposing said medication located in said first container.

4. The self-contained medication apparatus of claim 1, said second container further comprising:

a cylindrical portion connected to said second semi-spherical portion; and a top surface formed as part of said cylindrical portion, said second seal connected to said top surface.

5. The self-contained medication apparatus of claim 4, further comprising a second tab connected to said second seal, wherein said second tab is pulled to remove said second seal from said top surface, exposing said consumable liquid located in said second container.

6. The self-contained medication apparatus of claim 1, said locking mechanism further comprising:

a divot formed as part of said second container, said divot creating a contactable area having a wall thickness of material that is less than the remainder of the second container wall thickness;

wherein pressure is applied to said bottom surface in an area in proximity to said divot to cause said overhanging lip and said angled lip to deflect, said first contact surface to rub against said second contact surface, and said bottom surface to lift away from said ledge, separating said first container from said second container, allowing said first container and said second container to be moved to said open position.

7. The self-contained medication apparatus of claim 1, further comprising a locking feature including said first deflection portion and said second deflection portion operable for locking said first container in said open position.

8. A self-contained medication apparatus, comprising:

a first container;

a second container;

a second semi-spherical portion formed as a lower part of said second container such that said self-contained medication apparatus has a rounded bottom surface;

a hinge member pivotally connecting said first container and said second container such that said first container and said second container are movable between an open position and a closed position, wherein said hinge member is a locking hinge to maintain a flat open position of said hinge member and hold said first container and second container in said open position;

a locking feature operable for locking said first container and said second container in said open position, said locking feature being part of said hinge member; a locking mechanism provides a connection between said first container and said second container when said first container and said second container are in said closed position; said locking mechanism further comprising: an overhanging lip formed as part of said first container; an angled portion formed as part of said overhanging lip, said angled portion having a first contact surface; an angled lip formed as part of said second container, said angled lip having a second contact surface in contact with said first contact surface when said first container and said second container are in said closed position; and a bottom surface formed as part of said overhanging lip, said bottom surface operable for being selectively in contact with a ledge formed as part of said second container when said first container and said second container are in said closed position; a first deflection portion and a second deflection portion, wherein said first deflection portion and said second deflection portion lock said first container in said open position at one-hundred-eighty degrees relative to the position of said first container when in said closed position;

a first seal, said first seal being part of said first container; a second seal, said second seal being part of said second container; a medication disposed in said first container such that when said first seal is removed from said first container, said medication is able to be removed and consumed; and a consumable liquid disposed in said second container such that when said second seal is removed from said second container, said consumable liquid is able to be removed and consumed, wherein said second container is operably sized to contain a maximum amount of consumable liquid of not more than about 2.7 ounces;

wherein said self-contained medication apparatus is a single-use medication apparatus which is disposable and formed of recyclable material and dispenses a single dosage of medication and liquid.

9. The self-contained medication apparatus of claim 8, further comprising:

a first semi-spherical portion, said first semi-spherical portion formed as part of said first container;

a lip formed as part of said first semi-spherical portion, said first seal being disposed on said lip;

a cylindrical portion connected to said second semi-spherical portion; and a top surface formed as part of said cylindrical portion, said second seal being disposed on said top surface;

wherein said first seal is removed from said lip, allowing said medication to be removed from said first container, and said second seal is removed from said top surface, allowing said consumable liquid to be removed from said second container.

10. The self-contained medication apparatus of claim 8, further comprising:

a first tab connected to said first seal, said first tab is pulled to remove said first seal from said lip; and a second tab connected to said second seal, said second tab is pulled to remove said second seal from said top surface.

11. The self-contained medication apparatus of claim 8, wherein said locking mechanism provides a snap-fit connection between said first container and said second container when said first container and said second container are in said closed position.

12. The self-contained medication apparatus of claim 8, said locking mechanism further comprising:

a divot formed as part of said second container, said divot creating a contactable area having a wall thickness of material that is less than the remainder of the second container wall thickness;

wherein pressure is applied to said bottom surface in an area in proximity to said divot to cause said overhanging lip and said angled lip to deflect, said first contact surface to rub against said second contact surface, and said bottom surface to lift away from said ledge, separating said first container from said second container, allowing said first container and said second container to be moved to said open position.

13. A self-contained medication apparatus, comprising: a first container having a first semi-spherical portion; a second container having a second semi-spherical portion and a cylindrical portion formed with said second semi-spherical portion such that said self-contained medication apparatus has a rounded bottom surface;

a hinge member, said first container pivotally connected to said second container by said hinge member between an open position and a closed position, wherein said hinge member is a locking hinge to maintain a flat open position of said hinge member and hold said first container and second container in said open position;

a locking feature operable for locking said first container and said second container in said open position;

a locking mechanism for providing a snap-fit connection between said first container and said second container when said first container and said second container are in said closed position;

a first seal having a first tab, said first seal connected to said first semi-spherical portion; the locking mechanism provides a connection between said first container and said second container when said first container and said second container are in said closed position; said locking mechanism further comprising: an overhanging lip formed as part of said first container; an angled portion formed as part of said overhanging lip, said angled portion having a first contact surface; an angled lip formed as part of said second container, said angled lip having a second contact surface in contact with said first contact surface when said first container and said second container are in said closed position; and a bottom surface formed as part of said overhanging lip, said bottom surface operable for being selectively in contact with a ledge formed as part of said second container when said first container and said second container are in said closed position; a first deflection portion and a second deflection portion, wherein said first deflection portion and said second deflection portion lock said first container in said open position at one-hundred-eighty degrees relative to the position of said first container when in said closed position;

a second seal having a second tab, said second seal connected to said cylindrical portion;

at least one type of medication disposed within said first container; and a consumable liquid disposed within said second container, wherein said second container is operably sized to contain a maximum amount of consumable liquid of not more than about 2.7 ounces;

wherein said first tab of said first seal is pulled to remove said first seal from said first container, allowing access to said medication, and said second tab is pulled to remove said second seal from said second container, allowing access to said consumable fluid such that said medication and said consumable fluid may be ingested, wherein no surface is required to support or operate said self-contained medication apparatus;

wherein said self-contained medication apparatus is a sanitary pre-sealed single-use medication apparatus which is disposable and formed of recyclable material and dispenses a single dosage of medication and liquid.

14. The self-contained medication apparatus of claim 13, wherein said hinge member is connected to said first semi-spherical portion and said cylindrical portion.

15. The self-contained medication apparatus of claim 13, said locking mechanism further comprising:

a divot formed as part of said cylindrical portion, said divot creating a contactable area having a wall thickness of material that is less than the remainder of the second container wall thickness;

wherein pressure is applied to said bottom surface in an area in proximity to said divot to cause said overhanging lip and said angled lip to deflect, said first contact surface to rub against said second contact surface, and said bottom surface to lift away from said ledge, separating said first container from said second container, allowing said first container and said second container to be moved to said open position.

16. The self-contained medication apparatus of claim 13, further comprising;

a lip formed as part of said first semi-spherical portion, said first seal being connected to said lip; and a top surface formed as part of said cylindrical portion, said second seal being connected to said top surface;

wherein said first seal and said second seal separate said first container and said second container when said first seal is connected to said lip and said second seal is connected to said top surface.

* * * * *